US005686684A

United States Patent [19]

Nagata et al.

[11] Patent Number: 5,686,684

[45] Date of Patent: Nov. 11, 1997

[54] EFFECT ADAPTOR ATTACHABLE TO KARAOKE MACHINE TO CREATE HARMONY CHORUS

[75] Inventors: Yuichi Nagata; Masao Yoshida; Mikio Kitano, all of Hamamatsu, Japan

[73] Assignee: Yamaha Corporation, Hamamatsu, Japan

[21] Appl. No.: 708,701

[22] Filed: Sep. 5, 1996

[30] Foreign Application Priority Data

Sep. 19, 1995 [JP] Japan ..... 7-240325

[51] Int. Cl.[6] ..... G10H 1/02

[52] U.S. Cl. ..... 84/631; 84/DIG. 4; 434/307 A

[58] Field of Search ..... 84/609–614, 631, 84/634–638, DIG. 4, 625; 434/307 A

[56] References Cited

U.S. PATENT DOCUMENTS 5,521,326 5/1996 Sone ..... 84/631

*Primary Examiner*—Stanley J. Witkowski

*Attorney, Agent, or Firm*—Loeb & Loeb LLP

[57] ABSTRACT

A harmony adaptor is optionally usable as an attachment to a karaoke apparatus which has a pickup device for collecting a live singing sound and converting the same into a vocal signal, and a mixing device for mixing the vocal signal with a music signal representative of a karaoke music sound and for acoustically reproducing the live singing sound accompanied by the karaoke music sound according to the mixed ones of the vocal signal and the music signal. The harmony adaptor is detachably connectable to the pick-up device for receiving therefrom the vocal signal. The harmony adaptor generates a harmony signal which originates and separates from the received vocal signal and which represents a harmony chorus sound made consonant with the live singing sound. The harmony adaptor is detachably connectable to the mixing device for transmitting thereto the received vocal signal and the generated harmony signal concurrently with each other so as to enable the mixing device to acoustically reproduce the harmony chorus sound according to the transmitted harmony signal along with the live singing sound and the karaoke music sound.

8 Claims, 1 Drawing Sheet

EFFECT ADAPTOR ATTACHABLE TO KARAOKE MACHINE TO CREATE HARMONY CHORUS

BACKGROUND OF THE INVENTION

The present invention relates to a sound effect adaptor which can be suitably used as an attachment to a karaoke apparatus.

There is a conventional karaoke music system which mixes a live singing sound picked up by a microphone with a karaoke music sound containing a main melody part and an accompaniment part, and which reproduces the mixed sounds through a speaker. There is a new karaoke system (not the prior art but the prior work) which generates a harmony chorus sound musically harmonizing with the live singing sound. The new karaoke system having such a harmonizing facility comprises a mixing amplifier to mix a vocal signal representative of the live singing sound with a music signal representative of the karaoke music sound. The mixing amplifier also accommodates therein a harmonizing effector such as a pitch shifter to generate a harmony signal to be mixed with the vocal signal.

In the prior art, if the harmonizing facility is required in the conventional karaoke apparatus which is not installed with any harmonizing facility, the mixing amplifier of the karaoke apparatus should be replaced by another mixing amplifier accommodating therein a harmonizing effector. Accordingly, the old mixing amplifier is wasted since the same is replaced by the new mixing amplifier.

SUMMARY OF THE INVENTION

The purpose of the present invention is to provide a sound effect adaptor or a harmony adaptor with which the harmonizing facility can be added easily to the karaoke system in combination with the existing mixing amplifier without wasting the same.

In order to achieve the above noted purpose, the inventive harmony adaptor apparatus is optionally usable as an attachment to a karaoke apparatus which has a pickup device for collecting a live singing sound and converting the same into a vocal signal, and a mixing device for mixing the vocal signal with a music signal representative of a karaoke music sound and for acoustically reproducing the live singing sound accompanied by the karaoke music sound according to the mixed ones of the vocal signal and the music signal. The harmony adaptor apparatus comprises input means detachably connectable to the pickup device for receiving therefrom the vocal signal, harmony generating means for generating a harmony signal which originates and separates from the received vocal signal and which represents a harmony chorus sound made consonant with the live singing sound, and output means detachably connectable to the mixing device for transmitting thereto the received vocal signal and the generated harmony signal concurrently with each other so as to enable the mixing device to acoustically reproduce the harmony chorus sound according to the transmitted harmony signal along with the live singing sound and the karaoke music sound. The inventive harmony adaptor apparatus further comprises switch means manually switchable between a vocal mode and a harmony mode for disabling the harmony generating means under the vocal mode so as to transmit only the vocal signal to the mixing device and otherwise for enabling the harmony generating means under the harmony mode so as to transmit also the harmony signal in addition to the vocal signal. In such a case, the input means and the output means cooperate with each other under the vocal mode for transmitting the received vocal signal as it is to the mixing device without changing an amplitude and a frequency characteristic of the vocal signal. In a specific form, the input means includes an amplifier for amplifying the received vocal signal and the output means includes an attenuator for reciprocally attenuating the amplified vocal signal so as to null an input/output gain of the vocal signal. The inventive harmony adaptor apparatus further comprises means for adjusting an amplitude and a frequency characteristic of the harmony signal separately from the vocal signal.

DETAILED DESCRIPTION OF THE INVENTION

Figure 1:
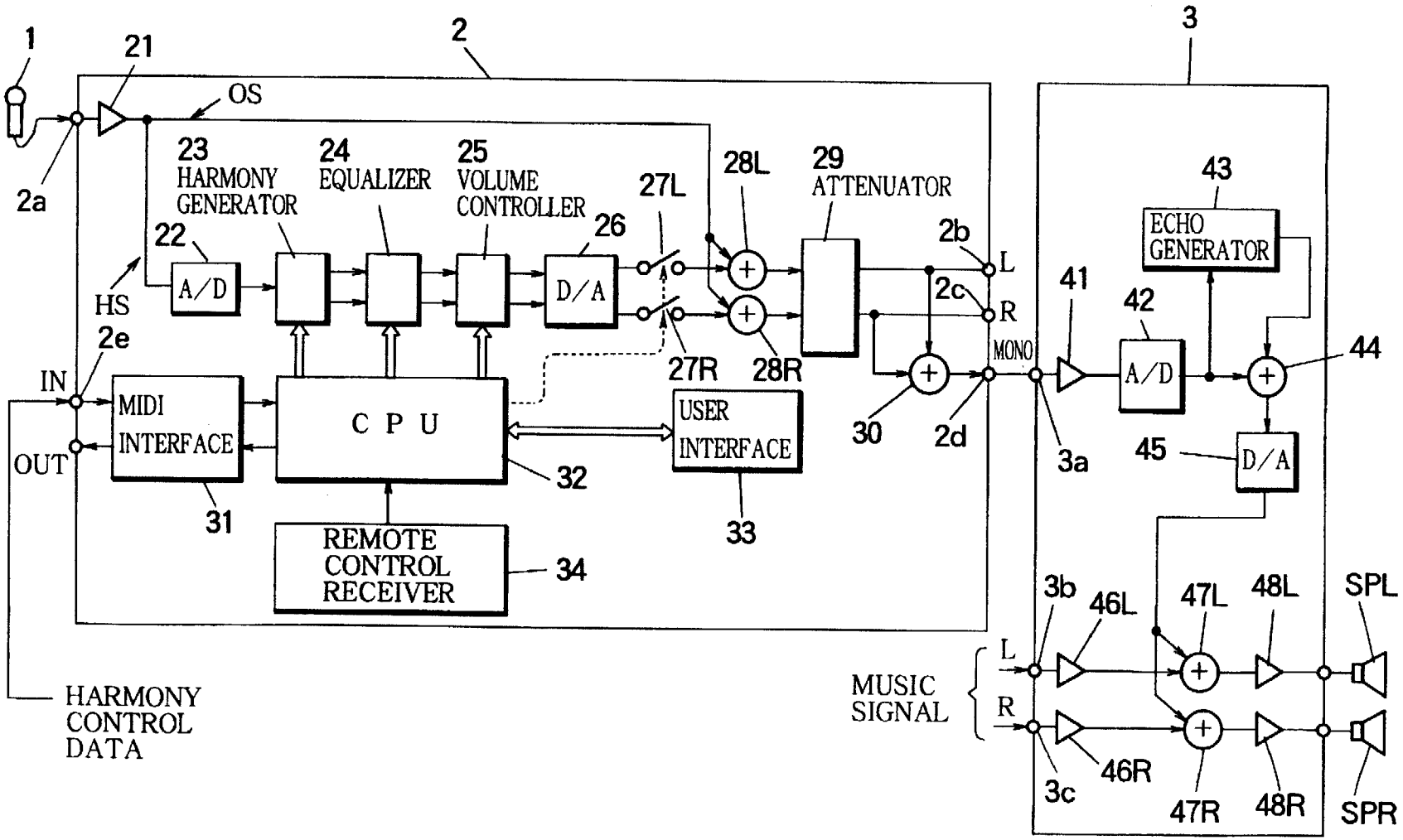
FIG. 1 is a schematic block diagram showing an embodiment of the inventive karaoke music system which includes the inventive harmony adaptor.

Details of an embodiment of a sound effect adaptor or harmony adaptor according to the present invention will now be described with reference to FIG. 1. The embodiment relates to a specific harmony adaptor employed in a network karaoke music system which reproduces a karaoke music sound according to MIDI (Musical Instrument Digital Interface) data distributed from a host computer by a telecommunication network. FIG. 1 illustrates the inventive harmony adaptor usable as an attachment to the karaoke music system according to the present invention. In FIG. 1, a pickup device or pickup unit in the form of a microphone 1 picks up a live singing sound of a karaoke singer, and converts the same into an electric vocal signal. A harmony adaptor apparatus or harmony adaptor unit in the form of a sound effect adaptor 2 is detachably connected between the microphone 1 and a microphone terminal 3*a* of a mixing device or mixing unit in the form of a mixing amplifier 3.

The sound effect adaptor 2 is comprised of a microphone amplifier 21, an A/D (Analog/Digital) converter 22, a harmony generator 23, an equalizer 24, a volume controller 25, a D/A (Digital/Analog) converter 26, a pair of switches 27L and 27R to turn on/off the harmony effect, a pair of adders 28L and 28R, an attenuator 29, an adder 30, a MIDI interface 31, a CPU 32, a user interface 33, and a remote control receiver 34. The microphone amplifier 21 amplifies the vocal signal received through a microphone input terminal 2*a* connectable to the microphone 1 with a predetermined gain. The vocal signal amplified by the microphone amplifier 21 is branched or divided into an original sound line OS and a harmony generation line HS.

In the harmony generation line HS, the A/D converter 22 converts the analog vocal signal fed from the microphone amplifier 21 into a corresponding digital signal. The harmony generator 23 functions as harmony generating means to generate a harmony signal representative of a harmony chorus sound musically harmonizing with the original live singing sound under the control of the CPU 32, by shifting a pitch of the digital vocal signal fed from the A/D converter 22. The generated harmony signal is divided into L (left) and R (right) channels, and is then fed to the equalizer 24. The equalizer 24 adjusts frequency characteristics of the L and R harmony signals under the control of the CPU 32. The volume controller 25 adjusts volume levels of the L and R harmony signals fed from the equalizer 24 according to the control of the CPU 32. The D/A converter 26 converts the volume-controlled harmony signals into corresponding analog signals. The switches 27L and 27R are controlled by the CPU 32 to turn on or off the outputs of the D/A converter 26. In other words, the sound effect adaptor 2 can be switched between a harmony mode in which the harmony signals are added to the vocal signal, and a vocal mode in which the vocal signal is outputted as it is without the harmony signal. The switches 27L and 27R are turned off in the vocal mode, and otherwise turned on in the harmony mode.

The adders 28L and 28R mix the L and R harmony signals fed from the D/A converter 26, respectively, with the L and R vocal signals fed from the original sound system OS. The attenuator 29 attenuates the mixed L and R signals. The attenuation level in the attenuator 29 is set to cancel the gain of the microphone amplifier 21. For example, if the gain of the microphone amplifier 21 is set to 10 dB, −10 dB is set for the gain (attenuation) level of the attenuator 29. Thus, the input/output gain of the vocal signal becomes 0 dB. The L and R output signals of the attenuator 29 are lead to a pair of output terminals 2*b* and 2*c*. Separately, the L and R output signals are mixed with each other by the adder 30 and outputted from a monaural output terminal 2*d*, which is detachably connected to the input terminal 3*a* of the mixing amplifier 3.

The MIDI interface 31 mediates input/output data exchange between the CPU 32 and an external storage device such as a hard disk drive which stores the MIDI data distributed from the host computer. For example, if a harmony control data contained in the MIDI data is inputted from a terminal 2*e*, the MIDI interface 31 sends the data to the CPU 32. The harmony control data contains a main melody pattern which indicates a melody line of the live singing sound, and a chorus melody pattern which designates a melody line of the harmony chorus sound. The CPU 32 calculates a pitch difference between the main melody pattern and the chorus melody pattern. The harmony generator 23 shifts a pitch of the vocal signal according to the calculated pitch difference to generate the harmony signal so that the harmony chorus sound is made consonant with the live singing sound according to the harmony control data contained in the MIDI data of a requested karaoke song.

The CPU 32 controls the whole system of the sound effect adaptor 2. The user interface 33 is comprised of a key input device and a display. Input information fed from the user interface 33 is sent to the CPU 32, and various messages from the CPU 32 are displayed on the display of the user interface 33. The remote control receiver 34 receives a light signal from a remote controller operated by the user, and converts the received light signal into an electric signal, which is sent to the CPU 32. The CPU 32 controls the harmony generator 23 according to the harmony control data inputted through the MIDI interface 31. The CPU 32 also controls the equalizer 24 and the volume controller 25 in response to the various input information fed from the user interface 33 and the remote control receiver 34.

The mixing amplifier 3 is comprised of a microphone amplifier 41, an A/D converter 42, an echo generator 43, an adder 44, a D/A converter 45, amplifiers 46L and 46R, adders 47L and 47R, and amplifiers 48L and 48R. The amplifier 41 amplifies the composite vocal signal containing live singing sound and the harmony chorus sound, received through the input terminal 3*a* from the sound effect adaptor 2, by a predetermined gain. The A/D converter 42 converts the amplified composite vocal signal fed from the microphone amplifier 41 into a digital signal. The echo generator 43 produces echo components for the composite vocal signal outputted from the A/D converter 42. The adder 44 mixes the echo components with the composite vocal signal fed from the A/D converter 42. The D/A converter 45 converts the digital signal fed from the adder 44 into an analog signal. The amplifiers 46L and 46R respectively amplify the L and R karaoke music signals fed from source input terminals 3*b* and 3*c* by a predetermined gain. The karaoke music signal is generated by an external tone generator according to the MIDI data distributed from the host computer. The adders 47L and 47R mix the echo-added composite vocal signal fed from the D/A converter 45 and the karaoke music signal with respect to the L and R channels. The amplifiers 48L and 48R further amplify the mixed L and R signals to drive speakers SPL and SPR.

The operation of the above described embodiment will be explained hereunder. The operation of the sound effect adaptor 2 will be described with respect to the two modes, which are the harmony mode and the vocal mode. When the karaoke singer starts to sing a karaoke song after commencing the play-back of the MIDI data distributed from the host computer in the harmony mode, the live singing sound is picked up by the microphone 1, and is sent to the sound effect adaptor 2. In the sound effect adaptor 2, the vocal signal amplified by the microphone amplifier 21 branches into the original sound line OS and the harmony generation line HS. No signal processing is applied to the vocal signal branched into the original sound line OS, until the vocal signal is mixed with the harmony signal as described later. The vocal signal branched into the harmony generation line HS is converted into a digital signal by the A/D converter 22, and is then fed to the harmony generator 23. The harmony generator 23 shifts the pitch of the vocal signal according to the harmony control data so as to produce the L and R harmony signals. The generated harmony signals are frequency-adjusted by the equalizer 24, and their volume is adjusted by the volume controller 25. Finally the harmony signals are converted into the analog signals by the D/A converter 26.

In the harmony mode, the switches 27L and 27R are turned on so that the adders 28L and 28R mix the L and R vocal signals fed from the original sound line OS, respectively, with the generated L and R harmony signals. The mixed L and R signals are attenuated by the attenuator 29, and are then mixed with each other by the adder 30 for transmission to the mixing amplifier 3 through the monaural output terminal 2*d*.

The mixing amplifier 3 adds the echo components to the harmonized composite vocal signal, and then splits the monaural signal into stereo signals. The stereo signals of the L and R channels are respectively mixed with the L and R karaoke music signals inputted from the source input terminals 3*b* and 3*c* by means of the adders 47L and 47R. The resulted stereo signals are amplified by the amplifiers 48L and 48R, and are then acoustically reproduced by the speakers SPL and SPR.

The vocal mode is explained hereunder. In the vocal mode, the switches 27L and 27R are turned off so that the L and R vocal signals branched into the original sound line OS are outputted as they are without accompanying the harmony signal. The vocal signal inputted from the terminal 2*a* is amplified by the amplifier 21, and is then attenuated by the attenuator 29 to the original volume level. Accordingly, the input/output gain for the original vocal signal is 0 dB. The frequency characteristic of the vocal signal is never modified in the vocal mode. The original vocal signal fed to the mixing amplifier 3 is added with the echo components and is then mixed with the karaoke music signal. The mixed signals are reproduced through the speakers SPL and SPR as in case of the harmony mode.

As described above, the inventive harmony adaptor 2 is optionally usable as an attachment to a karaoke apparatus which has a pickup device composed of the microphone 1 for collecting a live singing sound and converting the same into a vocal signal, and a mixing device is Y the form of the mixing amplifier 3 for mixing the vocal signal with a music signal representative of a karaoke music sound and for acoustically reproducing the live singing sound accompanied by the karaoke music sound according to the mixed ones of the vocal signal and the music signal. In the harmony adaptor 2, the input means including the input terminal 2*a* is detachably connectable to the microphone 1 for receiving therefrom the vocal signal. The harmony generating means in the form of the harmony generator 23 generates a harmony signal which originates and separates from the received vocal signal and which represents a harmony chorus sound made consonant with the live singing sound. The output means including the output terminal 2*d* is detachably connectable to the mixing amplifier 3 for transmitting thereto the received vocal signal and the generated harmony signal concurrently with each other so as to enable the mixing amplifier 3 to acoustically reproduce the harmony chorus sound according to the transmitted harmony signal along with the live vocal sound and the karaoke music sound. The harmony adaptor 2 further includes switch means composed of the switches 27L and 27R switchable between the vocal mode and the harmony mode for disabling the harmony generator 23 under the vocal mode so as to transmit only the vocal signal to the mixing amplifier 3 and otherwise for enabling the harmony generator 23 under the harmony mode so as to transmit also the harmony signal in addition to the vocal signal. The input means including the amplifier 21 and the output means including the attenuator 29 cooperate with each other under the vocal mode for transmitting the received vocal signal as it is to the mixing amplifier 3 without changing an amplitude and a frequency characteristic of the vocal signal. In detail, the input means includes the amplifier 21 for amplifying the received vocal signal and the output means includes the attenuator 29 for reciprocally attenuating the amplified vocal signal so as to null the input/output gain of the vocal signal. Further, the harmony adaptor 2 includes means composed of the volume controller 25 and the equalizer 24 for adjusting an amplitude and a frequency characteristic of the harmony signal separately from the vocal signal. The harmony generator 23 shifts a pitch of the vocal signal to modify the same into the harmony signal.

In the embodiment described above, the harmony adaptor 2 is detachably connected between the microphone 1 and the mixing amplifier 3, so that the harmonizing facility can be added easily to the karaoke system using the already existing mixing amplifier without replacement thereof. In the vocal mode, the input/output gain of the harmony adaptor 2 is set to 0 dB and the frequency characteristic of the vocal signal is never changed in the harmony adaptor 2, so that it is possible to derive the same vocal signal characteristic as in the case where the microphone 1 is connected directly to the mixing amplifier 3. The frequency characteristic and the volume level of the harmony signal can be adjusted separately from the vocal signal in the embodiment above, so that the harmonizing effect added to the vocal signal can be controlled according to the user's preference.

In the embodiment above, the network karaoke apparatus generates the karaoke music accompaniment sound according to the MIDI data distributed from the host computer. However, the present invention can be applied to another karaoke apparatus in which the karaoke accompaniment sound is reproduced from LD (Laser Disc), CD (Compact Disc) and so on. In this arrangement, the harmony control data can be provisionally stored in a memory media such as a ROM rather than being distributed as the MIDI data.

As shown in the foregoing, according to the invention, the harmonizing facility can be added easily to the karaoke system without replacing the already existing mixing amplifier. According to the invention, the mode switching means switches between the vocal mode and the harmony mode. The input/output gain of the original vocal signal is set to 0 dB, and the original vocal signal is outputted without modification of its frequency characteristic. Consequently, in the vocal mode, it is possible to derive the same vocal signal characteristic as in the case where the microphone is connected directly to the mixing amplifier, and the mixing amplifier does not need to be adjusted with respect to its gain settings or tone control settings. According to the invention, the adjusting means to adjust the frequency characteristic and the volume level of the harmony signal is provided, so that it is possible to create a desired harmonizing effect suitable for performance of the karaoke mixing amplifier, frequency response of the speaker, ambient characteristic of a listening room and so on.

What is claimed is:

1. A harmony adaptor apparatus optionally usable as an attachment to a karaoke apparatus which has a pickup device for collecting a live singing sound and converting the same into a vocal signal, and a mixing device for mixing the vocal signal with a music signal representative of a karaoke music sound and for acoustically reproducing the live singing sound accompanied by the karaoke music sound according to the mixed ones of the vocal signal and the music signal, the harmony adaptor apparatus comprising:

input means detachably connectable to the pickup device for receiving therefrom the vocal signal;

harmony generating means for generating a harmony signal which originates and separates from the received vocal signal and which represents a harmony chorus sound made consonant with the live singing sound; and output means detachably connectable to the mixing device for transmitting thereto the received vocal signal and the generated harmony signal concurrently with each other so as to enable the mixing device to acoustically reproduce the harmony chorus sound according to the transmitted harmony signal along with the live singing sound and the karaoke music sound.

2. A harmony adaptor apparatus according to claim 1, further comprising switch means manually switchable between a vocal mode and a harmony mode for disabling the harmony generating means under the vocal mode so as to transmit only the vocal signal to the mixing device and otherwise for enabling the harmony generating means under the harmony mode so as to transmit also the harmony signal in addition to the vocal signal.

3. A harmony adaptor apparatus according to claim 2, wherein the input means and the output means cooperate with each other under the vocal mode for transmitting the received vocal signal as it is to the mixing device without changing an amplitude and a frequency characteristic of the vocal signal.

4. A harmony adaptor apparatus according to claim 1, wherein the input means includes an amplifier for amplifying the received vocal signal and the output means includes an attenuator for reciprocally attenuating the amplified vocal signal so as to null an input/output gain of the vocal signal.

5. A harmony adaptor apparatus according to claim 1, further comprising means for adjusting an amplitude and a frequency characteristic of the harmony signal separately from the vocal signal.

6. A harmony adaptor apparatus according to claim 1, wherein the harmony generating means comprises means for shifting a pitch of the vocal signal to modify the same into the harmony signal.

7. A karaoke music system comprising:

a pickup unit for collecting a live singing sound and converting the same into a vocal signal;

a mixing unit comprising an input terminal connectable to the pickup unit for receiving therefrom the vocal signal, means for mixing the vocal signal with a music signal representative of a karaoke music sound, and means for acoustically reproducing the live singing sound accompanied by the karaoke music sound according to the mixed ones of the vocal signal and the music signal; and a harmony adaptor unit comprising an input terminal connectable in place of the mixing device to the pickup unit for receiving therefrom the vocal signal, means for generating a harmony signal which originates and separates from the received vocal signal and which represents a harmony chorus sound made consonant with the live singing sound, and an output terminal connectable in place of the pickup device to the input terminal of the mixing unit for transmitting thereto the received vocal signal and the generated harmony signal concurrently with each other so as to enable the mixing unit to acoustically reproduce the harmony chorus sound according to the transmitted harmony signal along with the live singing sound and the karaoke music sound.

8. A karaoke music system according to claim 7, wherein the harmony adaptor unit comprises an attachment detachably connectable between the pickup unit and the mixing unit for creating the harmony chorus sound without changing the mixing unit.

* * * * *